US006761183B1

(12) United States Patent
Hoeptner, III

(10) Patent No.: US 6,761,183 B1
(45) Date of Patent: Jul. 13, 2004

(54) BACK FLOW PREVENTING ADJUSTABLE VALVE APPARATUS WITH FLUID ESCAPE

(76) Inventor: Herbert W. Hoeptner, III, 7796 Oak Springs Cir., Gilroy, CA (US) 95020

( * ) Notice: Subject to any disclaimer, the term of this patent is extended or adjusted under 35 U.S.C. 154(b) by 23 days.

(21) Appl. No.: 10/253,071

(22) Filed: Sep. 23, 2002

(51) Int. Cl.[7] ..... E03C 1/10
(52) U.S. Cl. ..... 137/218; 137/360; 137/625.26
(58) Field of Search ..... 137/218, 360, 137/606, 625.26

(56) References Cited

U.S. PATENT DOCUMENTS 2,569,857 A 10/1951 Jaegle et al
3,828,815 A * 8/1974 Botnick ..... 137/625.26
4,976,279 A * 12/1990 King et al. ..... 137/218
5,228,471 A 7/1993 Hoeptner
5,752,542 A 5/1998 Hoeptner
6,206,039 B1 * 3/2001 Shuler et al. ..... 137/360
6,386,223 B1 5/2002 Hoeptner, III

* cited by examiner

*Primary Examiner*—Gerald A. Michalsky
(74) *Attorney, Agent, or Firm*—William W. Haefliger

(57) ABSTRACT

In a valving assembly, the combination comprising an elongated hollow valve body having an inlet and an outlet for fluid flow, a valve in the body to control the flow, an elongated hollow stem movable in the body to open and close the valve, packing extending between portions of the stem and body, in spaced relation to the valve, a side drain port in and movable by the stem between a first position in which the port is blanked by the packing, and a second position in which the port is exposed to fluid in the body outside the stem, to pass such fluid into the stem for drainage.

7 Claims, 7 Drawing Sheets

BACK FLOW PREVENTING ADJUSTABLE VALVE APPARATUS WITH FLUID ESCAPE

BACKGROUND OF THE INVENTION

This invention relates generally to valves usable to deliver water from housing or building plumbing lines. More particularly, it concerns improvements to such valves, simplifying their construction, and enhancing their performance.

There is need in such valves for improvements associated with blocking or checking back flow where reverse flow pressure may build-up. Also, there is need in such valves for disposing of build-up back flow pressure, as during checking or blocking of such back flow to the building plumbing. Such back flow, if unchecked, could contaminate water in that plumbing.

U.S. Pat. No. 5,752,542 to Hoeptner discloses an improved valve constructed to meet the above needs. That valve incorporates the following:

a) an outer tubular member having a first flow port, b) an inner member having closure means thereon to close the port in relatively axially advanced position of the inner member, and to open the port in relatively axially retracted position of the inner member, c) control means to control relative movement of the inner member between those positions, d) an axially movable check valve positioned about the axis of the inner member to pass fluid flow from the port and to drain flow space defined between the members, and to block reverse fluid flow from that space and through the first port, in the inner member relatively retracted position, and e) a second port to pass fluid from that space in relatively retracted position of the inner member, thereby to relieve pressure of the fluid in the space.

There is further need to control pressurized fluid for escape from the interior of the valve at times when the check valve is positioned to block reverse fluid flow as referred to, and at other times to block such escape.

SUMMARY OF THE INVENTION

It is a major object of the invention to provide an improved, compact, simple, highly effective valve assembly meeting the above need. Basically, the assembly comprises:

a) an elongated hollow valve body having an inlet and an outlet for fluid flow, b) a valve in said body to control said flow, c) an elongated hollow stem movable in the body to open and close the valve, d) packing extending between portions of the stem and body, in spaced relation to the valve, e) a side drain port in and movable by the stem between a first position in which the port is blanked by the packing, and a second position in which the port is exposed to fluid in the body outside the stem, to pass such fluid into the stem for drainage.

As will appear, the valve in the body to control such flow typically includes a back flow controlling check valve, which may be carried by the stem, in axially spaced relation to the packing and side drain port, It is another object to configure the valve to be open when the port is in said first position, and the valve is closed when the port is in said second position.

Another object includes provision of a handle attached to said stem externally of said body to rotate the stem in the body, the side drain port located between the handle and valve. The stem may have screw thread attachment to the body to effect endwise movement of the stem relative to the body when the handle is rotated, thereby to carry the port between said first and second positions.

A further object is to provide an elongated tubular body in which the stem and valve are received, that body having a side outlet, and the valve comprising a check valve engagable with and disengagable from a bore in the tubular body, in spaced relation to the body side outlet.

A yet further object includes provision of a back siphonage controlling check valve assembly connected in series with the body side outlet; and in which said additional check valve assembly may have a side discharge port via which fluid can escape under excess pressure conditions.

An additional object includes provision of a deflector associated with a diaphragm controlled side discharge port to deflect fluid escaping under such excess pressure conditions.

These and other objects and advantages of the invention, as well as the details of an illustrative embodiment, will be more fully understood from the following specification and drawings, in which:

DRAWING DESCRIPTION

Figure 6:
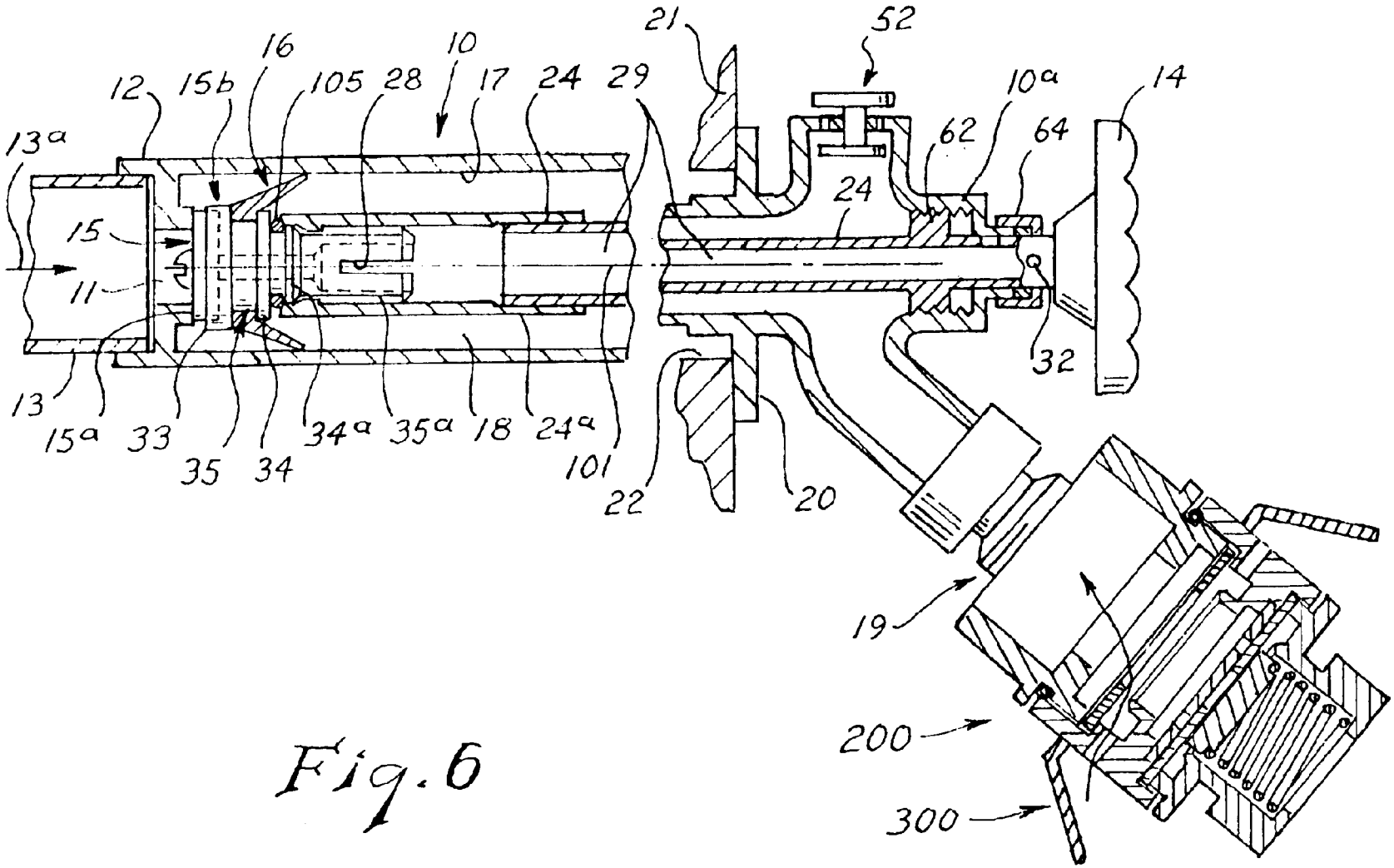
FIG. 6 is like FIG. 3, but shows a modification.
Figure 6A:
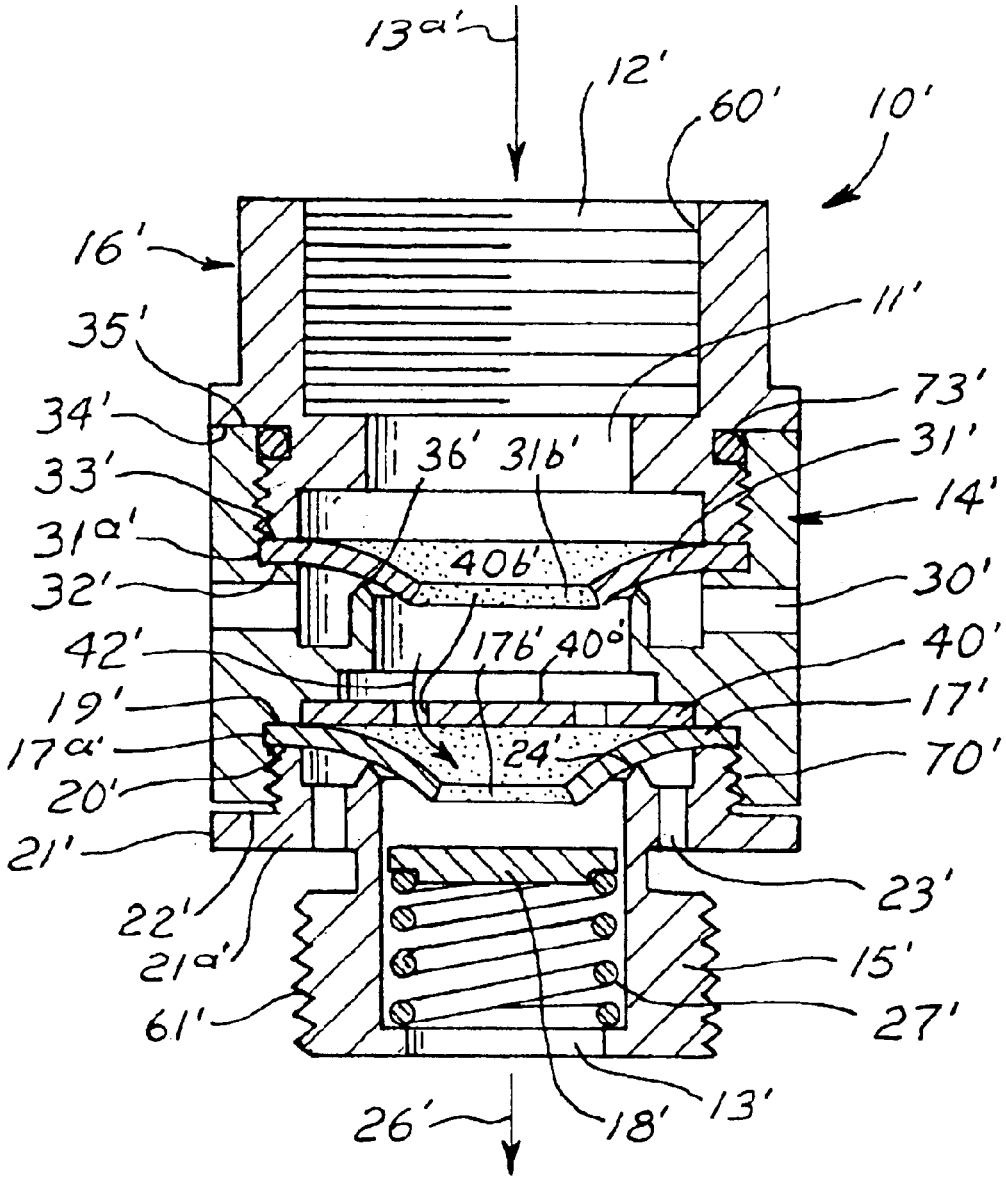
Figure 6B:
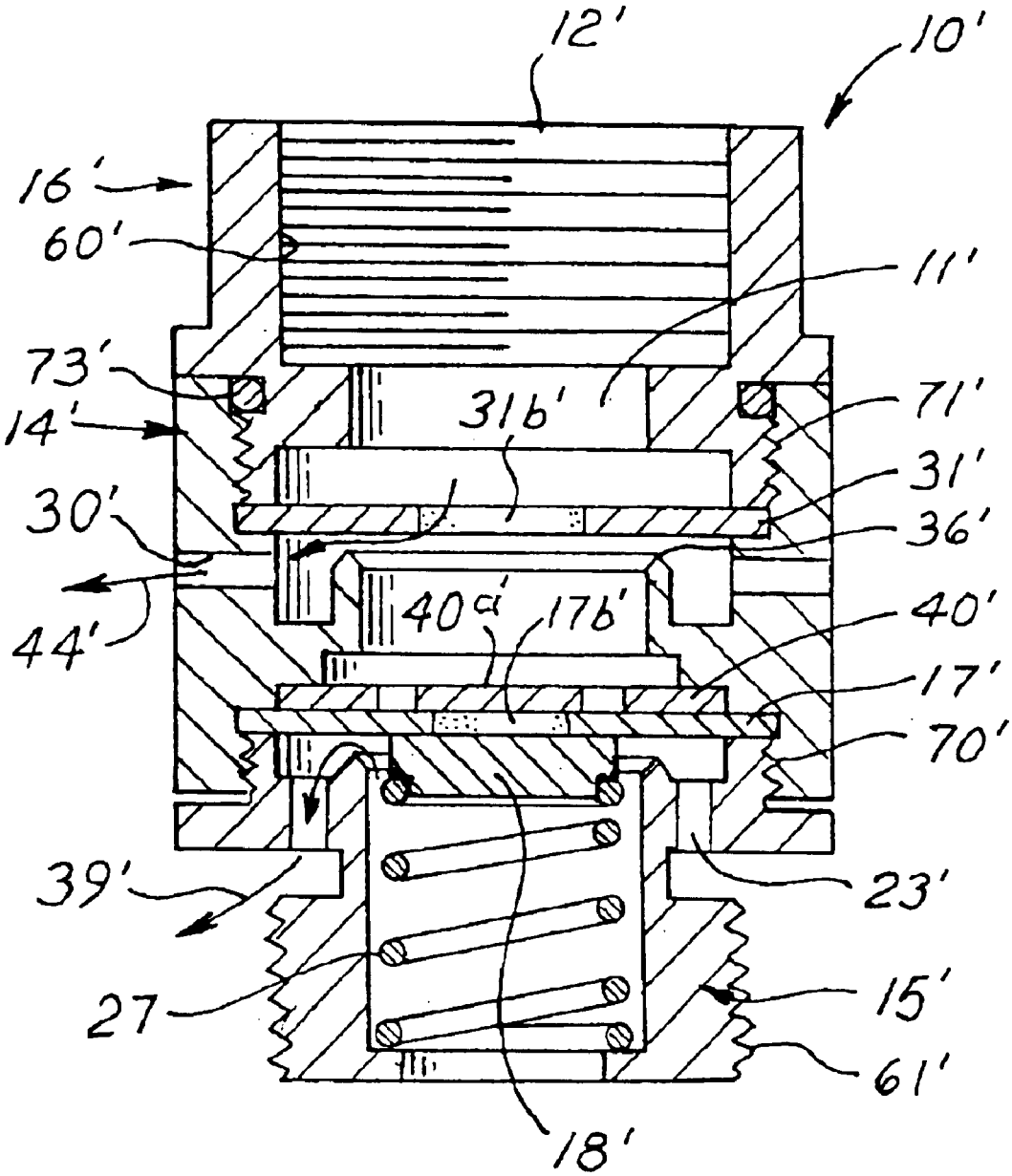

FIGS. 6*a* and 6*b* are sectional views of a check valve assembly seen in FIG. 6.

DETAILED DESCRIPTION

In the drawings, an outer tubular member as at 10 has a first flow port 11 at one end of the member. A female fitting 12 at that end is adapted to receive a male pipe end 13 (see FIG. 2) to which water pressure is communicated at 13*a* typically at about 60 psi. When a control means such as valve handle 14 is rotated in one direction, a closure means such as a valve stopper or plug 15 is backed away from a seat 15*a* in member 10, allowing pressurized water to flow past check valve 16, in bore 17, and then to flow via space 18 to fitting 19, as for delivering water from plumbing in a residence. See FIG. 2. A flange 20 on the member 10 is engageable with a wall 21 of the building, to position member 10 in a bore 22 in that wall.

Figure 2:
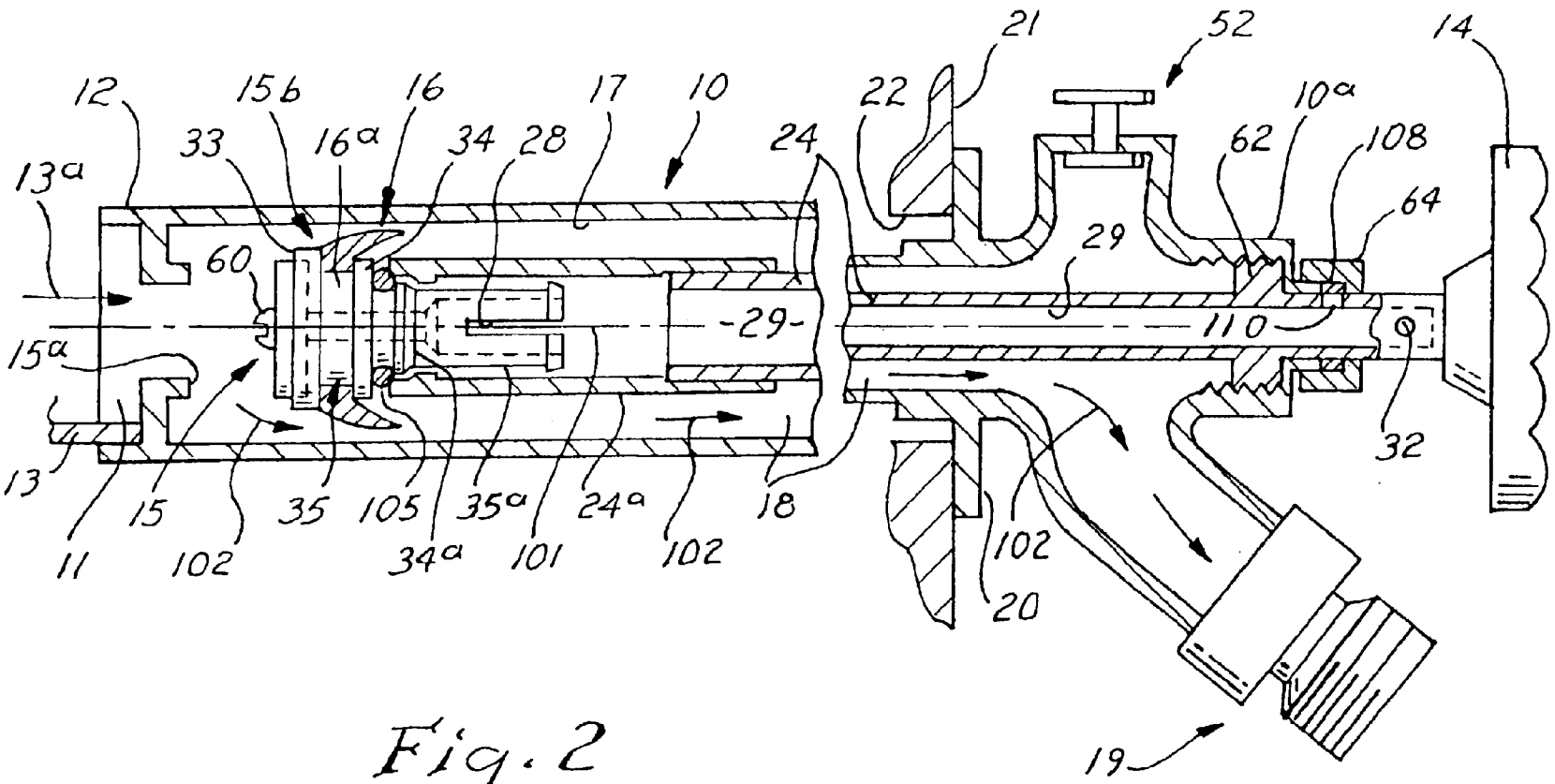
FIG. 2 is a vertical side elevation taken through the FIG. 1 assembly, to show internal construction; the valve being in flow passing open (ON) condition.
Figure 3:
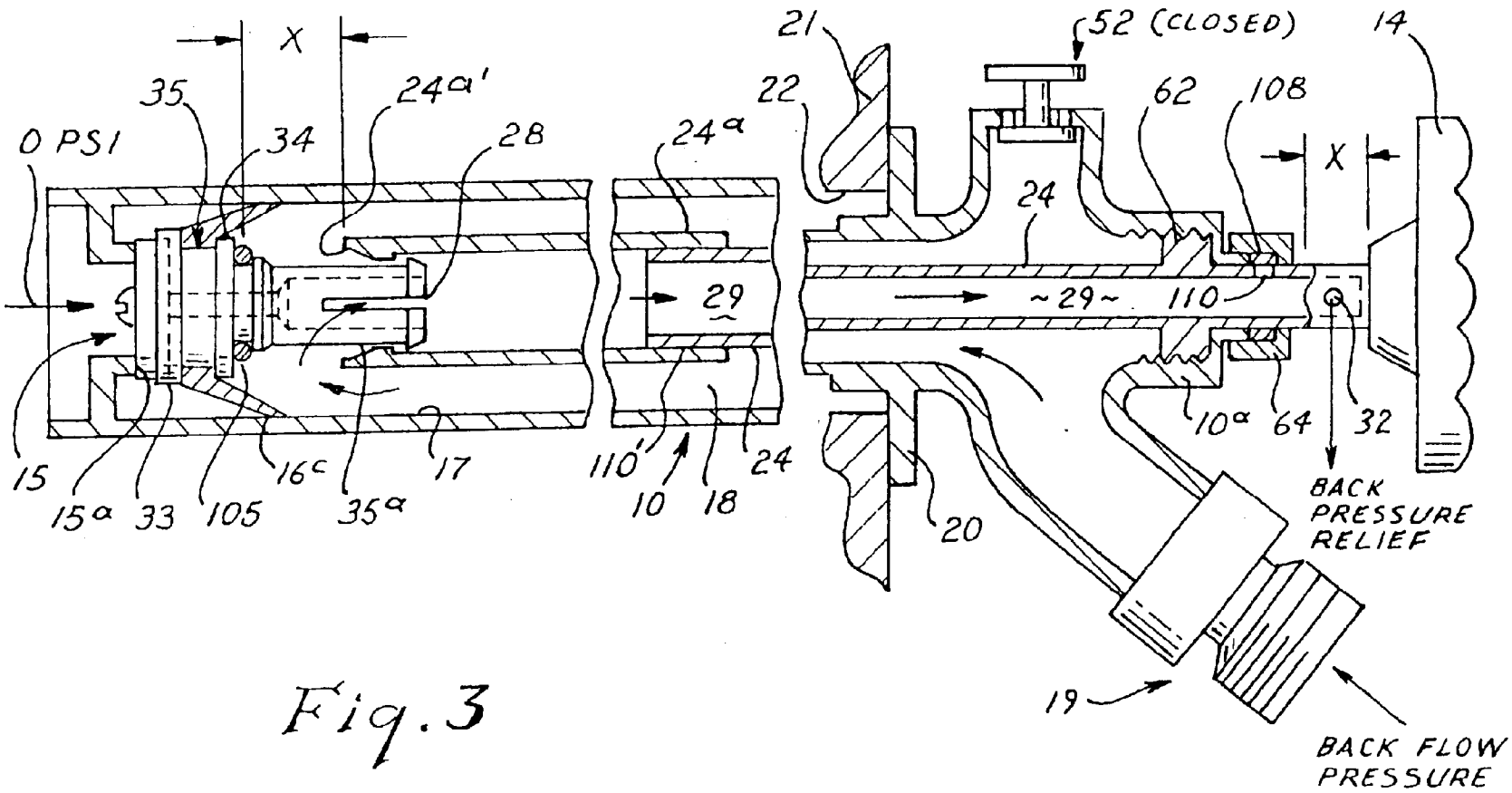
FIG. 3 is an enlarged section like FIG. 2 showing the valve assembly in ON condition, with backflow and back pressure being relieved.

The closure assembly 15*b* is carried by an elongated inner member 24, which in its leftward advanced position, of FIG. 3 is urged against the seat. In rightward retracted position of FIG. 2 the member 15 is spaced from the port 11 to open the latter.

Check valve 16 shown as annular, to be positioned about the axis 101 of inner member 24. It is configured to deflect and to pass the flow rightwardly, as referred to above (see flow arrows 102 in FIG. 2), and to block reverse fluid flow (back-flow) from space 18 leftwardly past the check valve and to and through first port 11, as in FIG. 3 position. Thus, potentially contaminating back flow as from a hose via fitting 19 to port 11 is prevented.

A second port is provided, as at 28, to pass back-flow fluid from space 18, as in FIG. 3, to relieve build-up of pressure of fluid in that space. As shown in FIG. 3, second port is provided by an axially extending slot 28 in the side wall of a tubular stem extension 35*a* of a body 35 that carries 16. Stem extension 35*a* slides telescopically in a sleeve extension 24*a* of tubular member 24. As seen in FIG. 3, fluid in passage 18 flows via slot 28 into the elongated bore or passage 29 in 24. Fluid may escape from the passage 29 as via a side port 32 near handle 14. Port 32 leads to the exterior. Port or slot 28 is not exposed to space 18 when flow from first port 11 passes rightwardly past the check valve as in FIG. 2, i.e. port 28 is then covered, since extension 35*a* is then retracted rightwardly by flow pressure into sleeve extension 24*a* on 24. See FIG. 2. However, if backpressure builds up in space 18, as in FIG. 3, check valve 16 is then pushed to the left, uncovering the port 28, to allow escape or relief of backpressure in space 18. FIG. 3 shows stopper 15 sealed against seat 15*a*.

Note in this regard the positioning of the check valve inner annular body 16*a* between two flanges 33 and 34 on axially movable body 35 that carries closure or stopper 15 at the leftward end of body 35. Body 35 carries an O-ring 105 between flange 34 and flange 34*a*, to seat at tapered seat end 24*a* of extension 24*a*', as in FIG. 2, thereby isolating slot 28 from passage 18. As shown in FIG. 2, pressurized drain flow cannot escape via slit port 28 to the bore 29 of member 24. However, when back-flow pressure dominates (in open condition of the valve handle), it forces valve 16 to the left, carrying body 35 to the left, and slit port 28 then becomes exposed to passage 18, due to travel of O-ring 105 leftwardly away from the tapered seat end of sleeve 24*a*. Back flow pressure can then be relieved via slit port 28 and bore 29 to the exterior.

Note that check valve 16 has a frusto-conical annular lip 16*c* with an edge wiping annularly against bore 17, when moved leftwardly to FIG. 3 position. No spring is required to move valve 16 leftwardly.

A fastener 60 is shown extending axially to retain stopper 15 plate to flange 33 of assembly 15*b*, allowing its replacement, after a threaded plug 62 is removed from the rightward barrel end 10*a* of 10. A nut 64 on 62 allows such plug removal. Plug 62 is integral with 24 to threadably engage 10*a* for advancing and retracting 24 as the handle is turned.

Figure 1:
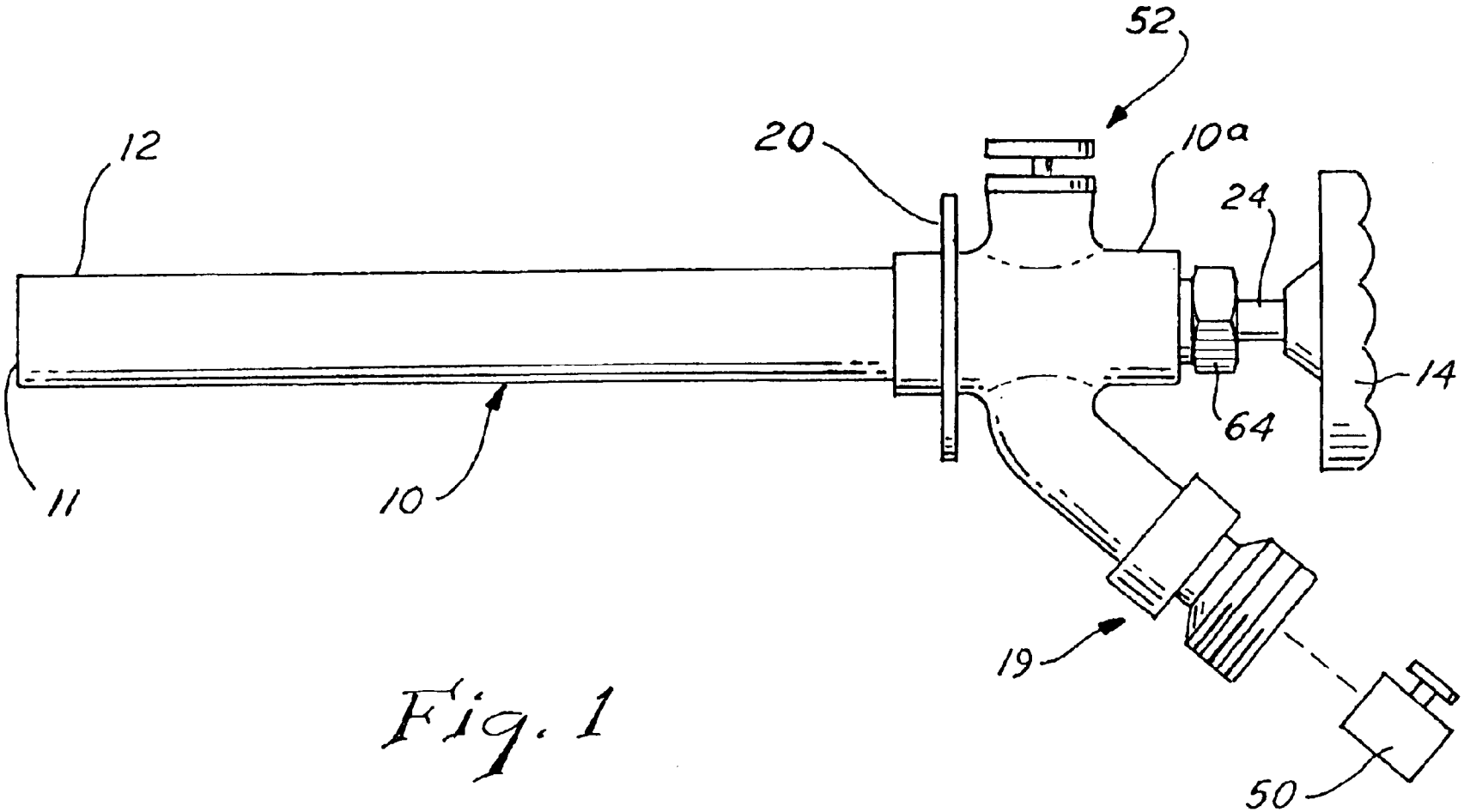
FIG. 1 is an external elevation showing a valve assembly incorporating the invention.

FIG. 1 also illustrates a valve 50 in series with drain fitting 19; and FIGS. 2 and 3 show an air pressure relief control at 52, in the side of member 10, near the handle.

FIG. 3 shows a solder joint at 110', between 24 and 24*a*.

Figure 4:
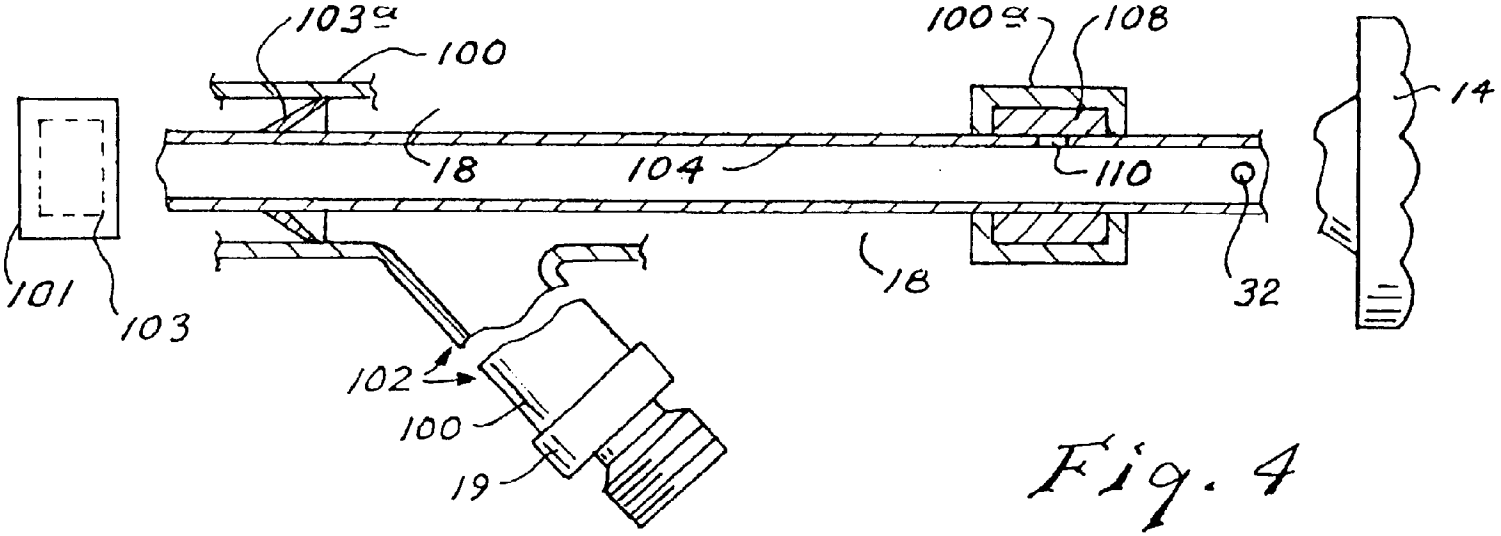
FIG. 4 is an enlarged view of a portion of FIG. 2, with added fluid escape structure, in a blanked condition.

In FIG. 4, is an enlarged valve body 100 that has an inlet 101 and a side outlet 102 for fluid flow. A valve 103 is located in the body to control such flow, and may include a check valve unit 103*a* of the general type described at 16, as well as a valve of the type described above at 15. An elongated hollow stem 104 is movable in the body by control handle 14 to open and close the valve, such as valve 15 as referred to. Packing 108 extends between and seals off between stem 104 and body part 100*a*, in spaced relation to valve 103. As shown, packing 108 has fixed position relative to body part 100*a*.

Figure 5:
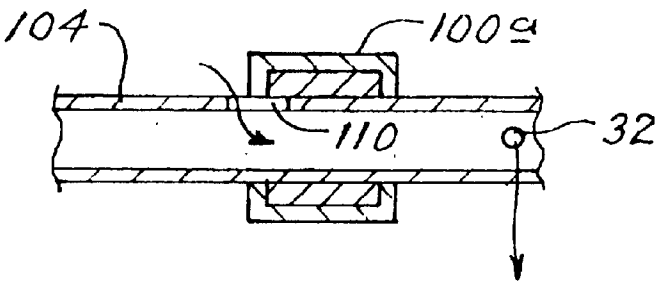
FIG. 5 is like FIG. 4, but showing the fluid escape structure in fluid passing condition.

A side drain port 110 is provided, in and movable by the stem between a first position in which the port is blanked by the packing, and a second position in which the port is exposed to fluid in the body at 18 outside the stem, to pass such fluid into the stem for drainage at 32. Thus, back-flow pressure as in a hose connected to 19, can be directly relieved (see FIG. 5) via uncovered drain port 110, to prevent back-flow siphonage to space 11 and into residential plumbing. FIGS. 2 and 3 also show packing 108 and side drain port 110.

Referring to FIG. 6, it shows a back siphonage controlling check valve assembly 200 connected in series with the body side outlet duct 201.

In FIGS. 6, 6*a* and 6*b*, a tubular body means 10' has main through passage structure 11' between entrance and exit ports 12' and 13'. The direction of forward fluid flow is indicated by arrow 13*a*' in FIG. 6*a*. By way of example, the tubular body means may advantageously comprise a first tubular section 14', a second tubular section 15' and a third tubular section 16'; and such sections may be assembled in telescoping relation, as in the manner shown. A first flexible diaphragm 17' is carried by the body means to be exposed to flow in the passage means. Also, a stopper 18' is provided in the passage means to cooperate with the first diaphragm to pass forward fluid flow while the first diaphragm flexes forwardly, as seen in FIG. 6*a*. As shown, the first diaphragm is annular and may have its outer annular extent 17*a*' retained between annular shoulder 19' formed by the first body section 14' and annular shoulder 20' formed by the second section 15'. Flange 21' on the second section engages a rim 22' on the first section to limit closing of shoulder 20' toward shoulder 19' when the diaphragm is forcibly retained between its shoulders. Threads 70' may interconnect 14' and 15'.

Body means 10' also forms a first side port or ports 23' as for example in the flange 21' inner extent 21*a*', that port 23' adapted to communicate with the main passage structure in the tubular body prior to diaphragm flexing; however, when the diaphragm is flexed forwardly, as shown in FIG. 6*a*, it blocks exit flow of fluid from the main passage structure through the first side port or ports 23', as seen in FIG. 6*a*. Note that the second body section 15' has an annular seat 24' thereon presented toward the diaphragm and positioned to annularly seat the first diaphragm as it flexes to block exit flow of fluid through the first side port or ports. Under these conditions, flow passes through the diaphragm central opening 17*b*', then around the periphery of the stopper 18' and then outwardly through the exit port 13'. See arrow 26'. Flow pressure against the stopper displaces it downwardly to allow such flow to pass through central opening 17*b*' in diaphragm 17', a compression spring 27' in the second section 15' exerting upward return force on the stopper. That spring is compressed as the stopper is forced downwardly by flow pressure.

The body means also has a second side port or ports 30' for communicating with the interior passage structure 11', as shown in FIG. 6*a*. Under these conditions, the port or ports 30' act as a drain to discharge any remaining fluid above the level of the ports 30', assuming the device is generally vertically oriented, as shown. The second diaphragm 31' moves, i.e. flexes, to block exit flow through the second side port or ports 30 in response to the described forward flow of fluid through the main passage means, this condition being shown in FIG. 6*a*. Note that the second diaphragm outer annular extent 31*a*' may be captivated between opposed shoulders 32' on the first body section and 33' on the third body section in such manner as to allow the described flexing or movement of the second 10 diaphragm. Interengaged shoulders 34' and 35' of the sections 14' and 16' limit closure of shoulders 32' and 33' to captivate the second diaphragm. Threading at 71' removably connects 14' and 16'. See also annular seal 73'.

The first body section 14' is provided with an annular seat 36' facing toward the second diaphragm to seat the latter annularly when it is displaced downwardly, as shown, in response to flow through the device for closing or blocking exit flow of fluid through the second side port or ports 30'.

In accordance with an important aspect of operation, the stopper 18' cooperates with the first diaphragm 17' to block back flow of fluid through the main passage means when the first diaphragm moves upwardly in FIG. 6*b* to unblock exit back flow of fluid through the first side port 23'. See the exit flow arrow 39' in FIG. 6*b*. In this regard, a metallic disc 40' or equivalent support is provided in the body means to extend horizontally, i.e., normal to the flow, and to seat the first diaphragm 17' as it moves upwardly to unblock exit flow of fluid through the first side port 23'. The spring 27' then urges the stopper upwardly to engage the underside of the diaphragm 17', closing or blanking its central opening 17*b*', and thereby forcing the upper side of the diaphragm against the disc. The central portion 40*a*' of the disc then extends across the diaphragm central opening 17*b*' to block the escape of fluid through that opening and the diaphragm blocks escape of fluid through that opening and the diaphragm blocks escape of fluid through disc opening or openings 40*b*'. When the diaphragm is displaced downwardly, as in FIG. 6*a*, flow passes through disc opening or openings 40*b*' spaced radially outwardly of, or about, the disc central portion 40*a*'. See flow arrow 42'. Note also that the second annular diaphragm has a central opening 31*b*' to pass such flow downwardly, in FIG. 6*a*.

In FIG. 6*b*, the second diaphragm 31' is shown as having moved upwardly off the seat 36' to allow drainage flow of fluid through the second side port or ports 30', as indicated by flow arrow 44'.

Further features of the invention include the following: the two diaphragms are spaced apart lengthwise of the passage means so that they may flex independently. Each of the diaphragms is annular and has its outer periphery retained in fixed position relative to the body means, the latter having disconnectible sections to provide ready access to the diaphragms for removal and replacement. In this regard, while the sections may have threaded interconnections at 70' and 71', other forms of connection may be provided. Also, the stopper is movable in the passage means free of both of said diaphragms, and in spaced relation thereto.

The invention allows forward flow of fluid without sideward discharge, ports 23' and 30' being sealed, as clearly shown in FIG. 6*a*. In the event of attempted back flow, the FIG. 6*b* configuration is assumed and such back flow is discharged at 39'; and any remanent fluid above diaphragm 17' is sidewardly discharged, as indicated by arrow 44'. The position of the elements at rest when there is no back flow as are shown in FIG. 6*b*. Threaded connections may be provided internally at 60' for connection to upper ducting, and may be provided externally at 61' for connection to lower ducting.

An escape flow deflector is seen at 300 in FIGS. 6, 6*a* and 6*b*, to deflect fluid escaping sidewardly from 200, under excess pressure conditions.

I claim:

1. In a valving assembly, the combination comprising a) an elongated hollow valve body having an inlet and an outlet for fluid flow, b) a valve in said body to control said flow, c) an elongated hollow stem movable in the body to open and close the valve, d) packing extending between portions of the stem and body, in spaced relation to the valve, said packing having fixed position relative to said body, the stem movable relative to the packing, e) a side drain port in and movable by the stem between a first position in which the port is blanked by the packing, which surrounds said port, and a second position in which the port is exposed to fluid in the body outside the stem, to pass inflow of such fluid into the stem for drainage, such inflow not then being blanked by the packing, f) the valve having an open position endwise remotely from said port when the port is in said first position, and the valve having a closed position remotely from said port when the port is in said second position.

2. The combination of claim 1 wherein the valve comprises a back flow controlling check valve.

3. The combination of claim 1 including a handle attached to said stem exteriorly of said body to rotate the stem in the body, the side drain port located between the handle and valve.

4. The combination of claim 3 wherein the stem has screw thread attachment to the body to effect endwise movement of the stem relative to the body when the handle is rotated thereby to carry the port between said first and second positions.

5. The combination of claim 1 including an elongated tubular body in which the stem and valve are received, the body having a side outlet, and the valve comprising a check valve engageable with and disengageable from a seat in the tubular body, in spaced relation to the body and side outlet.

6. The combination of claim 5 including a back siphonage controlling check valve assembly connected in series with said body side outlet, said additional check valve assembly having a diaphragm controlled side discharge port via which fluid can escape under excess pressure conditions.

7. The combination of claim 6 including a deflector associated with said diaphragm controlled side discharge port to deflect fluid escaping under said excess pressure conditions.

* * * * *